United States Patent [19]

Shoemaker et al.

[11] Patent Number: 4,595,003

[45] Date of Patent: Jun. 17, 1986

[54] PROTECTIVE MASK FOR AIRBORNE TOXIC SUBSTANCES

[75] Inventors: Charles J. Shoemaker, Baldwin; John A. Scavnicky, Joppa; Malcolm E. Little, Fallston; Emily M. Hagy, Kingsville, all of Md.; Aaron Bloom, Los Angeles, Calif.

[73] Assignee: The United States of America as represented by the Secretary of the Army, Washington, D.C.

[21] Appl. No.: 544,144

[22] Filed: Oct. 21, 1983

[51] Int. Cl.[4] ..... A62B 7/00; A62B 18/08

[52] U.S. Cl. ..... 128/201.19; 128/201.25; 128/206.17

[58] Field of Search ..... 128/201.19, 201.15, 128/206.17, 206.12, 206.15

[56] References Cited

U.S. PATENT DOCUMENTS

| | | | |
|---|---|---|---|
| 2,652,828 | 9/1953 | Matheson | 128/201.19 |
| 2,740,400 | 4/1956 | Wines | 128/206.17 |
| 2,908,272 | 10/1959 | Motsinger | 128/201.15 |
| 3,180,333 | 4/1965 | Lewis | 128/201.19 |
| 3,181,531 | 5/1965 | Angioletti | 128/201.19 |
| 3,540,442 | 11/1970 | Holloway | 128/201.19 |
| 4,433,684 | 2/1984 | Sarnoff et al. | 128/206.17 |

FOREIGN PATENT DOCUMENTS

| | | | |
|---|---|---|---|
| 958903 | 2/1957 | Fed. Rep. of Germany | 128/201.15 |
| 971654 | 3/1959 | Fed. Rep. of Germany | 128/206.17 |
| 383783 | 1/1965 | Switzerland | 128/206.17 |
| 504827 | 4/1939 | United Kingdom | 128/206.15 |
| 572777 | 10/1945 | United Kingdom | 128/201.19 |

*Primary Examiner*—Henry J. Recla

*Attorney, Agent, or Firm*—Anthony T. Lane; Robert P. Gibson; Michael C. Sachs

[57] ABSTRACT

A protective mask includes a one-piece face piece molded of a transparent elastomer. A visor in the face piece provides panoramic visibility and is resilient enough to deform under applied force to permit improved use of optical devices. Identical left and right cheek fittings permit installation of a canister on either side so that the same mask can be used by right-handed and left-handed wearers. The cheek fitting not occupied by a canister is sealed with a voicemitter which transmits the wearer's voice for use with a telephone and the like. Air deflectors inside the mask adjacent the left and right cheek fittings deflect de-fogging air along the inside surface of the visor when either left or right or both cheek fittings are used for attachment of a canister. A sealing adapter permits sealing arund earpiece shafts of eyeglasses.

11 Claims, 5 Drawing Figures

PROTECTIVE MASK FOR AIRBORNE TOXIC SUBSTANCES

The invention described herein may be manufactured, used and licensed by or for the Government for Governmental purposes without the payment to us of any royalties thereon.

BACKGROUND OF THE INVENTION

The present invention relates to breathing devices and, more particularly, to breathing devices including protective masks for use in the presence of toxic or unpleasant airborne substances.

The possibility of encountering toxic or unpleasant airborne substances has led to the development of protective masks which filter or otherwise treat air before it is inhaled by the wearer. Such protective masks desirably have a number of attributes which are generally imperfectly achieved. A mask should interfere as little as possible with the wearer's activity, should have high adaptability to different wearers so that a small number of different sizes can fit an entire population, should be adaptable to all missions in which a wearer may be engaged, should be rapidly and easily donned and should provide positive and secure sealing to the user's body against the entry of the airborne substances.

Prior art protective masks fail in many of these categories and fail rather badly in some of these categories. Many prior art masks require four, five and more sizes to fit the entire user population. In addition, these masks significantly interfere with the wearer's vision, particularly a wearer who attempts to employ an optical apparatus such as binoculars or optical range finder. The rigid eyepieces of prior art protective masks space the eyepieces of the optical apparatus so far away from the wearer's eyes that the effective exit pupil of the optical apparatus is severely limited. In addition, prior art masks offer relatively poor downward vision.

Prior art masks require separate designs for each of a number of different missions. That is, a general purpose mask is not adaptable to vehicular applications and neither general purpose nor vehicular masks are suitable for aircrew applications. Furthermore, many prior art masks employ a single canister mounted on the side of the mask. Since the canister interferes with certain user activities such as, for example, firing a weapon, right-handed and left-handed masks are required which effectively doubles the inventory requirements.

Prior art masks are manufactured by molding a rubber face piece to which a lens system and other elements are attached at sealed seams. Besides increasing manufacturing cost due to the requirement for handling the large number of separate pieces, the prior art design poses a reliability problem since each of the seams presents a risk of seal failure thereby admitting the airborne substances which the mask is intended to exclude.

Prior art masks are molded in the folded condition. When such a mask must be donned, two hands are required to open it and to arrange the head straps prior to donning. These preliminary steps consume a number of seconds which may be critical in a close time situation.

OBJECTS AND SUMMARY OF THE INVENTION

Accordingly, it is an object of the invention to provide a protective mask which overcomes the drawbacks of the prior art.

It is a further object of the invention to provide a protective mask which substantially decreases interference with the user's activity.

It is a further object of the invention to provide a protective mask requiring substantially fewer sizes to accommodate an entire population of wearers.

It is a further object of the invention to provide a protective mask equally suited to right-handed and left-handed individuals.

It is a further object of the invention to provide a protective mask which is molded in the open condition so that donning is simplified and speeded up.

According to an embodiment of the invention, there is provided a protective mask comprising a one-piece face piece, said face piece including a transparent visor and a sealing perimeter, a left cheek fitting in the face piece, a right cheek fitting in the face piece, means for selectively permitting attachment of a canister to either one or both of the left cheek fitting and the right cheek fitting, said means for selectively permitting attachment also being effective for permitting sealing of a one of the left and right cheek fittings which is not used for attachment of a canister by a voicemitter, said voicemitter being effective to transmit the wearer's voice, a chin fitting in the face piece, sand said chin fitting being effective for permitting attachment of an exhalation valve.

According to a feature of the invention, there is provided a coating for a face piece of a protective mask, the protective mask being molded of a silicone elastomer, comprising a first layer of Viton ® applied to the face piece from a first solvent bath, a second layer of polyurethane applied to the face piece from a second solvent bath, and said Viton ® being effective to improve a gas permeation of the elastomer and the polyurethane being effective to improve an abrasion resistance of the face piece.

According to a further feature of the invention, there is provided a sealing system for sealing a perimeter of a protective mask to a temple region of a wearer wherein the wearer also wears glasses of the type having first and second earpiece shafts which pass from outside the mask to inside the mask, comprising a sealing perimeter on the mask, a seal flap attached to an inside surface of the sealing perimeter at least in the temple region, said seal flap being tapered and inclined toward a center of the mask, first and second sealing adapters fittable over the first and second earpiece shafts respectively, each of the sealing adapters including a longitudinal hole therein fittable over the earpiece shaft and effective to seal against passage of gas therebetween, each of the sealing adapters having a generally flattened cross section with upper and lower extremities tapered to a thin cross section, each of the sealing adapters having an inner surface sealingly fittable against the temple region, each of the sealing adapters having an outer surface against which the seal flap is sealingly fittable, and said thin cross sections of the extremities permitting sealing by the seal flap at transitions from the sealing adapter to the temple.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
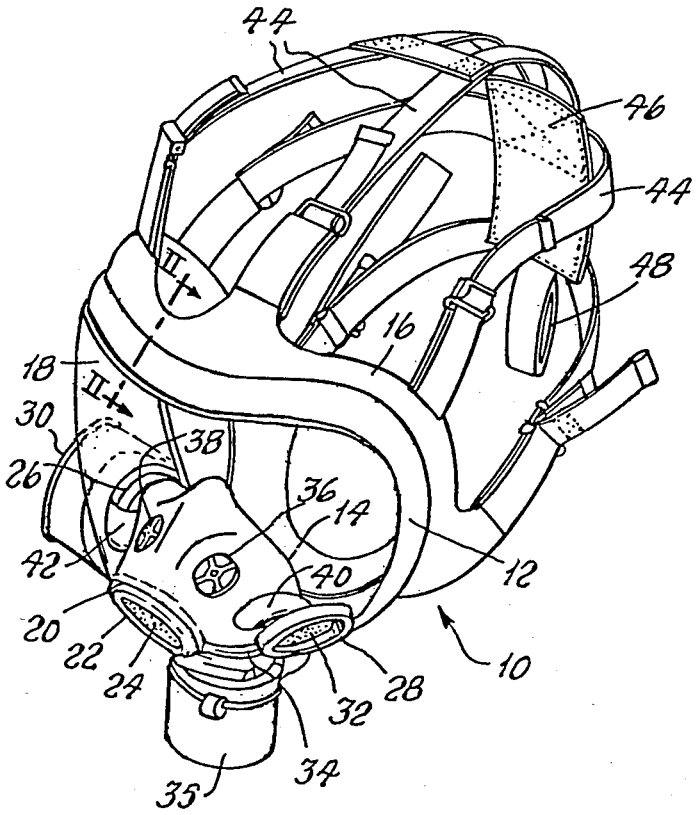
FIG. 1 is a perspective view of a protective mask according to an embodiment of the invention.

Referring now to FIG. 1, there is shown, generally at 10, a protective mask according to an embodiment of the invention. Mask 10 includes two molded one-piece plastic pieces, namely a face piece 12 and a nose cup 14. A sealing perimeter 16 surrounds a transparent visor 18 of face piece 12. Visor 18, which may have a toroidal, cylindrical, ellipsoidal or paraboloidal shape, provides panoramic vision to the wearer.

A front opening 20 in visor 18 includes a fitting 22 which is adapted to retain a voicemitter 24. Voicemitter 24 seals front opening 20 while permitting the wearer's voice to be projected outside mask 10. Voicemitter 24 is conventional and will therefore not be further detailed. Fitting 22 also provides a union between nose cup 14 and face piece 12. Any suitable means may be used for joining nose cup 14 to face piece 12, however, in the preferred embodiment, an expansion ring (not shown) is fitted into a mating groove (not shown) in nose cup 14 to thereby sealingly affix it to fitting 22.

Identical right and left cheek fittings 26 and 28 are disposed in visor 18 well out of the line of vision of the wearer. Either or both cheek fittings 26 and 28 may be employed to mount a canister 30 of filtration or other materials. When only one canister 30 is installed, as shown in FIG. 1, the one of cheek fittings 26 and 28 not occupied by canister 30 is sealed with a voicemitter.

The ability offered by the present invention to mount a canister on either side and to mount a voicemitter on the other side provides a number of significant advantages. For example, both left-handed and right-handed wearers are equally accommodated by simply selecting the side into which canister 30 or canister 30' is installed and installing voicemitter 32 in the other side, as is shown in FIG. 1, for example. In addition, the availability of voicemitter 32 on a selectable side of face piece 12 enables the wearer to communicate using a telephone or other such acoustic instrument with reduced difficulty.

That is, if it were more convenient for someone to use one side over the other, he could insert his voicemitter in that side and his hose-with-canister over on the other side. An example is a left-handed person who desired to use the telephone while freeing his hand for writing notes; he would want the voicmitter inserted on the right so a telephone could be held by his right hand over against the voicemitter, while he would put his hose with canister over on the left; since the hose is not needed to be held, his left hand would now be free for writing. He could talk and write at the same time without dropping the phone. Another example is in cramped spaces in a tank or space capsule for instance, where it just so happens that there is room on one side of the person for holding up a telephone and extending his arm, but that on the other there is simply no such room. He would insert his voicemitter therefore on the more free side of his body.

A chin fitting 34 in face piece 12 provides a sealing mount for an exhalation valve 35 to permit wearer exhalation without directing moisture-laden exhaled air into the area of visor 18. This is necessary to prevent fogging of visor 18.

Nose cup 14 includes a left cheek valve 36 and a right cheek valve 38. Check valves 36 and 38 permit air to flow from within visor 18 into nose cup 14 but block air flow in the reverse direction. Nose cup 14 includes a left air deflector 40 positioned adjacent to left cheek fitting 28 and a right air deflector 42 positioned adjacent right cheek fitting 26. The one of air deflectors 40 and 42 adjacent a cheek fitting (26 or 28) which contains canister 30 intercepts incoming air during inhalation and directs it in a sheet flow along the inner surface of visor 18 to keep visor 18 de-fogged. The bilateral symmetry including corresponding left-right pairs of fittings 26 and 28 and deflectors 40 and 42 makes the mounting side for canister 30 a matter of user choice since mounting canister 30 in either side provides the same de-fogging flow of air. When a canister 30 is mounted in both sides, the de-fogging air flow is reinforced.

Mask 10 is molded of a transparent silicone elastomer in a thickness sufficient to make it semi-rigid but still thin enough to permit visor 18 to deflect sufficiently under urging of binocular eyepieces, for example, pressed against its outer surface to flatten and to move a significant distance toward the wearer's eyes. This achieves a significant reduction in effective optical exit pupil. Although the selection of thickness for visor 18 depends on the exact composition of silicone elastomer chosen and the amount of flexibility which is deemed desirable, in the preferred embodiment, a silicone elastomer X4-2665, made by Dow Corning was molded to a thickness of 0.1 inch in a toroidal shape in visor 18. The toroidal shape and the thickness combined to provide panoramic vision with a degree of structural rigidity sufficient to permit mask 10 to retain its open shape shown in FIG. 1 but with enough resiliency to deflect under urging by optical eyepieces.

A set of six elastic head straps 44 connect face piece 12 to a head pad 46 having a pull tab 48 at its lower edge. Due to the smooth, snag-free shape of face piece 12, head straps 44 and head pad 46 can be pulled over visor 18 for stowage. Then, when the mask is to be donned, it can be clapped against the wearer's face without delay for opening it or for adjusting straps so that an immediate seal can be made between sealing perimeter 16 and the wearer's face. Then, head straps 44 and head pad 46 can be slid off visor 18 and into position on the wearer's head by pulling on pull tab 48.

A further utility for the flexibility of visor 18 is evident in aircrew applications wherein it is frequently desirable to relieve the pressure in the ears by pinching the nostrils and attempting to blow the nose. The embodiment of the inventon shown in FIG. 1 permits deforming visor 18 and nose cup 14 to perform this maneuver.

For undistorted vision, the portions of the mold (not shown) employed to form visor 18 must have smooth and polished surfaces of the appropriate shape. In the preferred embodiment, the mold portions employed to form visor 18 include polished chrome plated steel inserts.

Without further treatment ater molding, a silicone face piece is deficient in abrasion resistance and in its resistance to chemical agent permeation. The molded face piece is first treated by dip coating with Viton® from a solvent bath to improve its resistance to chemical agent permeation. The Viton®-coated face piece is then dip coated on both sides with urethane from a solvent bath to improve the abrasion resistance of the mask, particularly in the area of visor 18. To further improve the abrasion resistance of the coated visor 18, it may be exposed to an appropriate level of radioactivity. For example, visor 18 may be exposed to about 15 megarads of radiation from any convenient source to improve the durometer thereof.

If mask 10 becomes excessively abraded or scratched in use, it can be reconditioned by removing the coating layers using the original solvents and recoating with Viton and urethane.

Figure 2:
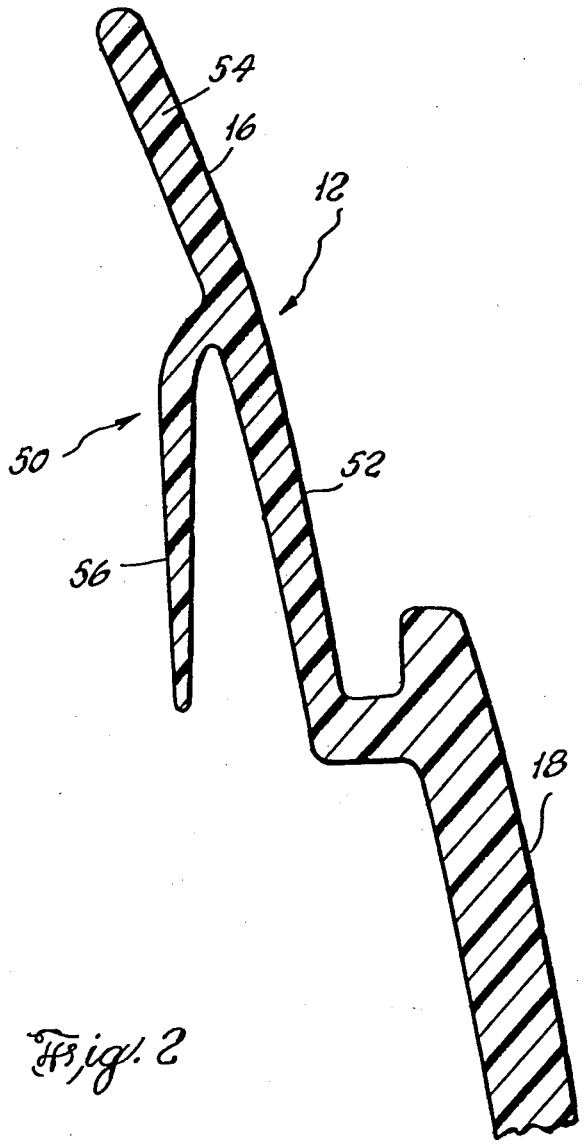
FIG. 2 is cross section taken along II—II of FIG. 1.

Referring now to FIG. 2, an inner surface 50 of sealing perimeter 16 includes an inner connecting region 52 contiguous to an outer sealing region 54. An inward-turned seal flap 56 is joined to inner surface 50 at the junction of inner connecting region 52 and outer sealing region 54. Seal flap 56 provides an extremely wide fitting range to sealing perimeter 16 thereby permitting a small range of mask sizes to accommodate an entire population of wearers.

A significant problem encountered in protective masks is devising a way to seal the entry of earpiece shafts of corrective eyeglasses into the mask. Such earpiece shafts typically enter a mask at the temple region of the wearer's head. This compounds a sealing problem that already exists in this region due to the typical indentation at the human temple. The great sealing flexibility of seal flap 56 is a great improvement in sealing in the temple region in the absence of earpiece shafts.

Figure 3:
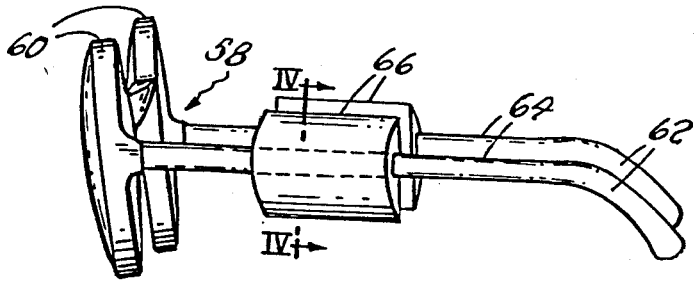
FIG. 3 is a perspective view of a pair of eyeglasses including sealing adapters according to an embodiment of the invention.

Referring now to FIG. 3, a pair of corrective glasses 58 is shown which includes a pair of lenses 60 to be positioned before the wearer's eyes inside the mask and a pair of earpieces 62 to be fitted over the user's ears outside the mask. A pair of earpiece shafts 64 connect lenses 60 to earpieces 62. In order to permit the use of standard corrective glasses, a sealing adapter 66 is slipped over each earpiece shaft 64 and positioned to lie in the region of the temple of the wearer's head that is contacted by seal flap 56.

Figure 4:
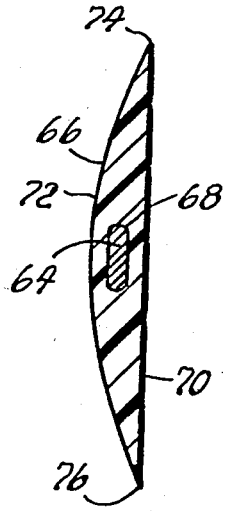
FIG. 4 is a cross section taken along IV—IV of FIG. 3.

Referring now also to FIG. 4, sealing adapter 66 is preferably made of a resilient elastic material having a longitudinal hole 68 therein. Sealing adapter 66 is slid over earpiece shaft 64 and seals against entry of gasses therebetween. Sealing adapter 66 is seen to have a generally flattened cross section with an inner surface 70 adapted for fitting and sealing against the wearer's temple and an outer surface 72 adapted for sealing contact with seal flap 56 (not shown in FIGS. 3 and 4). Extremities 74 and 76 of sealing adapter 66 are tapered to a thin cross section so that effective sealing can be maintained at the interface between extremities 74 and 76 and the wearer's temple.

When use of a protective mask may be anticipated, the wearer may equip earpiece shafts 64 with sealing adapters 66 in anticipation of such use. Then, if donning a protective mask is required, merely pressing the protective mask over the face provides effective sealing even over earpiece shafts 64.

Figure 5:
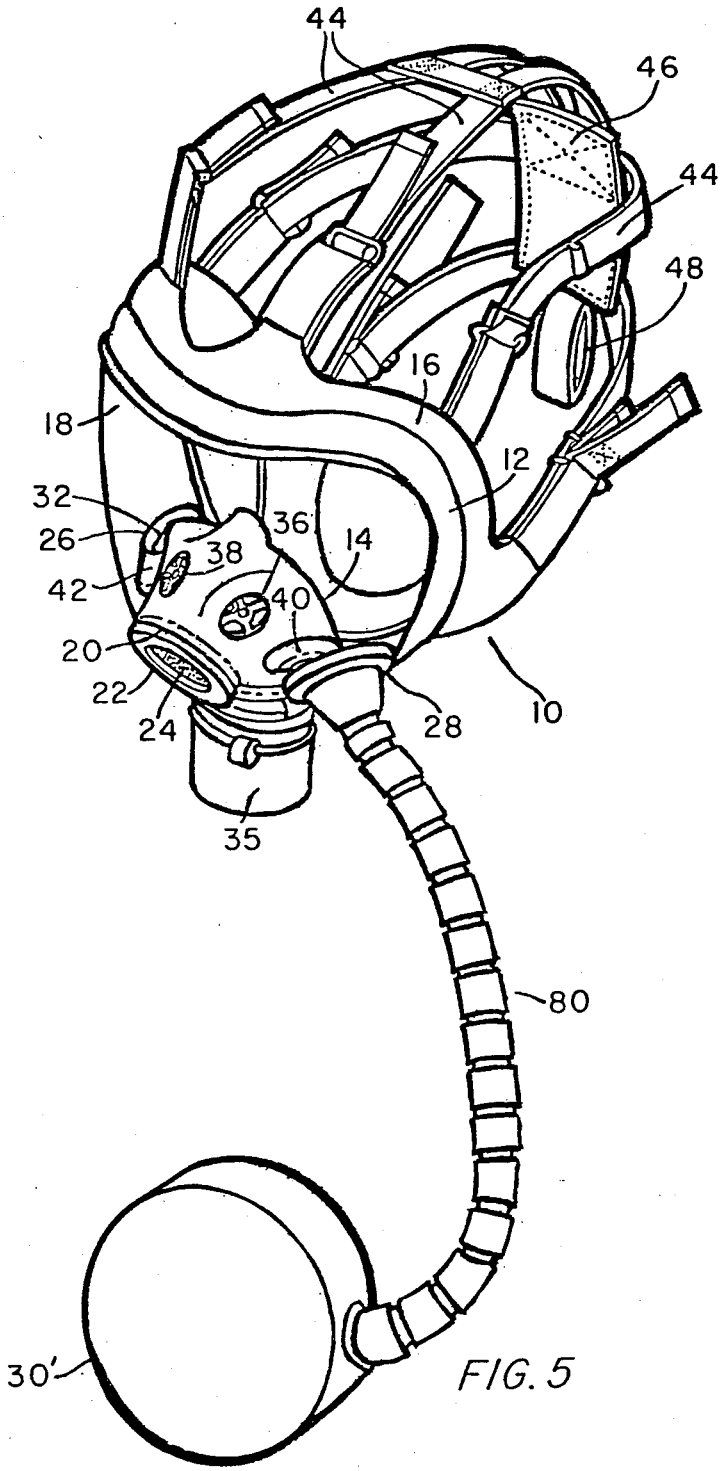
FIG. 5 is a perspective view of a protective mask with remote canister connected by flexible hose.

Referring again to FIG. 1, some applications make it preferable to separate canister 30 from face piece 12. In applications such as, for example, tank crew, canister 30' may be supported on the wearer's chest using a conventional carrying sling and connection to face piece 12 may be made using a conventional flexible rubber hose 80 fitting into either of fittings 26 or 28. Such an arrangement is shown, for instance, by FIG. 5. In addition, in applications requiring access to a microphone, a standard military microphone (not shown) may be incorporated into exhalation valve 35.

Having described specific preferred embodiments of the invention with reference to the accompanying drawings, it is to be understood that the invention is not limtied to those precise embodiments, and that various changes and modifications may be effected therein by one skilled in the art without departing from the scope or spirit of the invention as defined in the appended claims.

What is claimed is:

1. A protective mask comprising:

a one-piece face piece comprising a transparent visor and a sealing perimeter, said visor having disposed therein right and left respective openings over the cheek areas of a wearer, and lower central opening over the chin area of a wearer;

a filtration canister having an inlet and an outlet, a flexible hose having one end attached to the outlet of said canister;

voicemitter means effective to transmit a wearer's voice;

right and left cheek fittings mounted within said respective right and left openings with each including means adapted to be attached either to the other end of said flexible hose or to said voicemitter means;

said flexible hose other end being selectively attached to one of said cheek fittings, said voicemitter means being selectively attached to the other of said cheek fittings wherein said voicemitter means and said flexible hose are interchangeable between said left and right cheek fittings;

a chin fitting within said central opening in said face piece, an exhalation valve selectively attached to said chin fitting.

2. A protective mask according to claim 1 wherein said left and right cheek fittings and said chin fitting are integrally molded in said face piece.

3. A protective mask according to claim 1 wherein said means for selectively permitting attachment includes means for direct attachment of a canister to said face piece.

4. A protective mask according to claim 1 wherein said transparent visor includes a cross section sufficiently thin to permit substantial deformation thereof in response to a mechanical force applied thereto.

5. A protective mask according to claim 1 wherein said face piece is molded of a silicone elastomer.

6. A protective mask according to claim 1 wherein said face piece is molded in an open shape.

7. A protective mask according to claim 1 wherein said sealing perimeter includes a seal flap integrally formed on an inner surface thereof, said seal flap surrounding substantially an entire perimeter of said transparent visor and being effective to provide a substantially gas-tight seal with a user's body.

8. A protective mask according to claim 7 wherein said seal flap is turned inward toward a center of said face piece.

9. A protective mask according to claim 1 wherein said face piece includes a coating thereon effective to improve an abrasion resistance thereof.

10. A protective mask according to claim 1 wherein said face piece includes a coating effective to improve a permeation resistance thereof.

11. A protective mask comprising:

a one-piece face piece comprising a transparent visor and a sealing perimeter, said visor having disposed therein right and left respective openings over the cheek areas of a wearer, and lower central opening over the chin area of a wearer;

a filtration canister having an inlet and an outlet, a flexible hose having one end attached to the outlet of said canister;

voicemitter means effective to transmit a wearer's voice;

right and left cheek fittings mounted within said respective right and left openings with each including means adapted to be attached either to the other end of said flexible hose or to said voicemitter means;

said flexible hose other end being selectively attached to one of said cheek fittings, said voicemitter means being selectively attached to the other of said cheek fittings wherein said voicemitter means and said flexible hose are interchangeable between said left and right cheek fittings;

a chin fitting within said central opening in said face piece, an exhalation valve selectively attached to said chin fitting;

said mask further including a left air deflector inside said face piece, said left air deflector being effective to direct air inhaled through said left cheek fitting along an inside surface of said transparent visor for de-fogging thereof, and a right air deflector inside said face piece, said right air deflector being effective to direct air inhaled through said right cheek fitting along an inside surface of said transparent visor for de-fogging thereof whereby selective attachment of a canister in either of said left and right cheek fittings provides corresponding de-fogging of said inside surface.

* * * * *